US006131583A

United States Patent [19]

Draghetti

[11] Patent Number: 6,131,583

[45] **Date of Patent: *Oct. 17, 2000**

[54] METHOD OF CONVEYING BAR-SHAPED ARTICLES

[75] Inventor: Fiorenzo Draghetti, Medicina, Italy

[73] Assignee: G.D Societa' per Azioni, Bologna, Italy

[ * ] Notice: This patent is subject to a terminal disclaimer.

[21] Appl. No.: 09/129,532

[22] Filed: Aug. 5, 1998

[30] Foreign Application Priority Data

Aug. 6, 1997 [IT] Italy ..... BO97A0499

[51] Int. Cl.[7] ..... A24C 5/47

[52] U.S. Cl. ..... 131/94; 198/445

[58] Field of Search ..... 131/27.1, 28, 29, 131/33, 56, 57, 88, 94; 493/45; 198/418.3, 450, 458, 448, 418, 444, 445, 418.7, 427

[56] References Cited

U.S. PATENT DOCUMENTS 3,080,871 3/1963 Molins et al. .
3,372,702 3/1968 Bohn .
4,841,993 6/1989 Hinz et al. .
5,349,968 9/1994 Rizzoli et al. ..... 131/94

FOREIGN PATENT DOCUMENTS 0580150 1/1994 European Pat. Off. .

*Primary Examiner*—Stanley S. Silverman
*Assistant Examiner*—Robert McBride
*Attorney, Agent, or Firm*—Marshall, O'Toole, Gerstein, Murray & Borun

[57] ABSTRACT

A method of conveying bar-shaped articles on a filter-assembly machine, wherein first articles arranged in an orderly single succession are advanced crosswise with respect to a given traveling direction; the first articles are cut in half in a direction parallel to the traveling direction to form second articles; the second articles are rearranged to form a first and a second parallel, side by side succession of respective pairs of second articles; and the first and second successions of pairs of second articles are advanced in the traveling direction.

9 Claims, 2 Drawing Sheets

METHOD OF CONVEYING BAR-SHAPED ARTICLES

BACKGROUND OF THE INVENTION

The present invention relates to a method of conveying bar-shaped articles.

In particular, the present invention relates to a method of conveying cigarette portions on a filter-assembly machine for producing filter-tipped cigarettes.

In the tobacco industry, filter-tipped cigarettes are known to be formed using a method comprising the steps of forming, on a manufacturing machine, a continuous cigarette rod of tobacco enclosed in a tubular wrapping; cutting double cigarette portions off the cigarette rod, i.e. cigarette portions twice the length of the cigarette portion of a finished filter-tipped cigarette; and transferring the double cigarette portions to the input drum of a filter-assembly machine by means of a transfer device. On the filter-assembly machine, the double cigarette portions are arranged parallel and fed, in a single orderly succession and in a direction crosswise to their respective axes, to a cutting station where they are cut in half into pairs of single cigarette portions still arranged in said orderly succession. The single cigarette portions in each pair are then parted a given distance to receive, in between, a double filter and a band projecting between the two cigarette portions, and so form a group comprising a double filter, two single cigarette portions on either side of the double filter, and a projecting band. Each group is then rolled along a rolling path to wind the band about the double filter and respective ends of the single cigarette portions, and so form a double filter-tipped cigarette, which is then cut in half into a pair of single filter-tipped cigarettes.

Though still used successfully on many currently marketed machines, the above method is limited on account of rolling the groups along a rolling path resulting in tobacco fallout from the ends of the cigarette portions; which fallout is directly proportional to the rolling speed of the groups, and is therefore kept within acceptable limits by reducing the rolling speed and hence the output of the filter-assembly machine.

Increasing output by reducing the spacing of the groups is only possible up to a certain point, which is determined by the length of the projecting band, and beyond which one group would be superimposed on the band of the preceding group.

To overcome this drawback, Patent Application GB-A-2302791 provides for feeding a succession of double cigarette portions along a given plane to a cutting station where the double cigarette portions are cut to form a succession of pairs of single cigarette portions in said plane. The succession of pairs of single cigarette portions is then divided into two orderly successions, which are fed along separate superimposed planes for supply, together with respective double filters and respective bands, to respective superimposed rolling tracks to form two separate successions of double cigarettes.

This solution provides for high output of the filter-assembly machine, while at the same time halving rolling speed and so maintaining an acceptable degree of tobacco fallout. On the other hand, feeding the two successions of pairs of single cigarette portions along separate, substantially superimposed planes calls for at least three additional drums—as compared with a conventional filter-assembly machine with a rolling path extending in a single plane—thus complicating the design and increasing the production cost of the filter-assembly machine.

An alternative solution in Patent U.S. Pat. No. 4841993 provides for supplying a filter-assembly machine with two parallel orderly successions of side by side double cigarette portions; cutting the double cigarette portions into pairs of single cigarette portions arranged in said two parallel orderly successions, in which each pair in one succession is coaxial with a pair in the other succession; supplying the respective filters and bands to form groups arranged in said two successions; and rolling the groups along a common rolling path to form two successions of double cigarettes.

While providing for numerous advantages—a single rolling track and substantially the same number of drums as a conventional filter-assembly machine—the above method also involves several drawbacks by calling for twice the length of all the drums on the filter-assembly machine, thus creating problems as regards access to the filter-assembly machine components and support of the relatively long drums. Moreover, the above method calls for feeding the double cigarette portions in two side by side successions, thus complicating transfer of the double cigarette portions from the manufacturing machine.

SUMMARY OF THE INVENTION

It is an object of the present invention to provide a method of conveying bar-shaped articles, designed to eliminate the aforementioned drawbacks.

According to the present invention, there is provided a method of conveying bar-shaped tobacco articles on a filter-assembly machine, the method comprising the steps of feeding, in a given traveling direction and in a given plane, an orderly succession of bar-shaped first articles arranged crosswise to said traveling direction and in a first succession; cutting said first articles in half parallel to said traveling direction to form second articles arranged in said first succession; and rearranging said second articles to obtain an orderly second and third succession of respective first and second pairs of second articles; the method being characterized in that the second articles in said first succession are rearranged by moving the second articles substantially along said plane.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
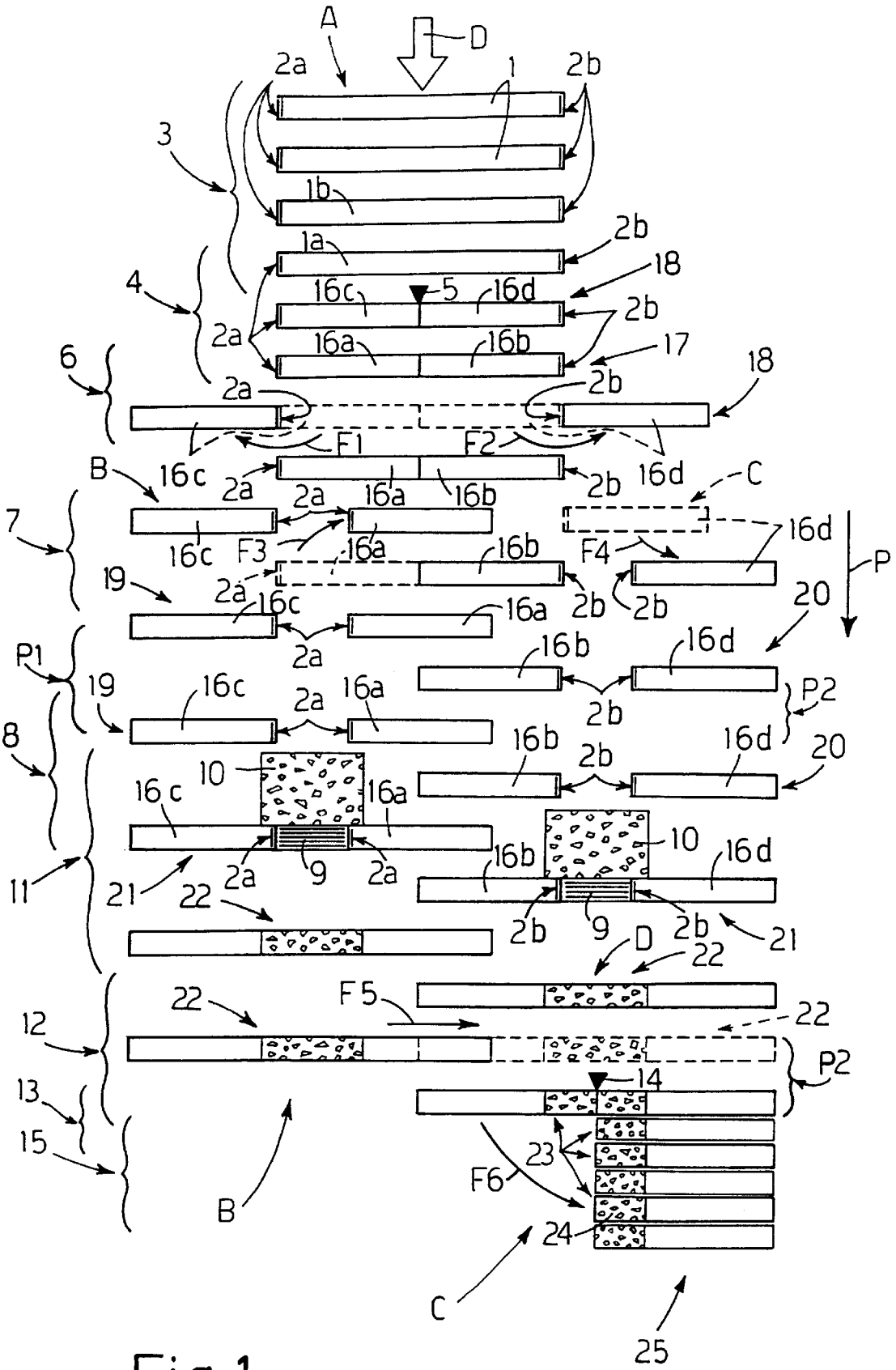
FIG. 1 shows, schematically, a sequence of operations according to a first embodiment of the method according to the present invention.

Number 1 in the accompanying drawing indicates a number of double cigarette portions, which are fed in a direction D, crosswise to their respective longitudinal axes, along a path P defined by a succession of known suction conveyor rollers (not shown) of a filter-assembly machine (not shown). Path P lies in a plane G defined by the surface of the rollers (not shown) and coincident with the plane of FIG. 1. Each portion 1 is substantially cylindrical, and has two opposite ends 2*a*, 2*b* formed by two successive cuts at a cutting station (not shown) of a cigarette manufacturing machine (not shown).

Along path P are arranged successively: a supply station 3; a cutting station 4 comprising a cutter 5; a turnover station 6; a pairing station 7; a station 8 for inserting double filters 9 and respective projecting gummed bands 10; a rolling station 11; an axial-transfer station 12; a cutting station 13 comprising a cutter 14; and a turnover station 15.

In actual use, portions 1 are transferred to supply station 3 by a transfer device (not shown) connecting the manufacturing machine (not shown) to the filter-assembly machine (not shown). Portions 1 are fed by said transfer device (not shown) successively and in equally spaced manner in direction D to the input of the filter-assembly machine (not shown), and are fed in an orderly succession A, still in direction D and by said conveyor rollers (not shown), through cutting station 4 where cutter 5 cuts each double portion 1 into two single cigarette portions 16.

For the sake of simplicity, reference will be made in the following description to two consecutive double portions 1*a* and 1*b*, double portion 1*a* preceding double portion 1*b* with reference to traveling direction D. Portions 1*a* and 1*b* are arranged alternately in succession A, and are fed through cutting station 4 where cutter 5 cuts portion 1*a* in half to form a pair 17 of single portions 16*a*, 16*b*, and cuts portion 1*b* in half to form a pair 18 of single portions 16*c*, 16*d*.

Pairs 17 and 18 are arranged in orderly fashion in succession A, and are fed through turnover station 6 where portions 16*a*, 16*b* in pair 17 are maintained coaxial and contacting each other end to end with respective ends 2*a*, 2*b* facing outwards, while portions 16*c*, 16*d* in pair 18 are turned over through 180° in opposite directions F1, F2, and positioned, in the same plane, coaxial with each other, separated by a distance substantially equal to the length of a double portion 1, and with respective ends 2*a*, 2*b* facing each other.

Pairs 17 and 18 of portions 16*a*, 16*b*, 16*c*, 16*d* are fed in the above configuration to pairing station 7 where portions 16*c*, 16*b* are kept in the same position with respect to each other and the conveyor roller (not shown), while portion 16*a* is moved, in the same plane, in the opposite direction to direction D into a position coaxial with portion 16*c*, and also in a direction perpendicular to direction D into a position separated by a given distance of amount (L) from portion 16*c*. The displacement in said two directions is indicated in FIG. 1 by arrow F3.

In substantially the same way, portion 16*d* is moved, in the same plane, in the same direction as direction D into a position coaxial with portion 16*b*, and also in a direction perpendicular to direction D into a position separated by a given distance of amount (L) from portion 16*b*. In FIG. 1, the displacement in said two directions is indicated by arrow F4; portions 16*a*, 16*d* indicated by the dash lines are those prior to displacements F3, F4; and portions 16*a*, 16*d* indicated by the continuous lines are those after displacements F3, F4.

In the above configuration, portions 16*a*, 16*b*, 16*c*, 16*d* form a pair 19 of coaxial portions 16*c*, 16*a* separated by a given distance of amount (L), and a pair 20 of coaxial portions 16*b*, 16*d* separated by a given distance of amount (L) and pairs 19 and 20 are fed in direction D in two successions B and C with the same spacing P1, and partially engage one another, combfashion, by a length smaller than the length of a single portion 16. That is, portion 16*b* of one pair 20 is partially inserted between two portions 16*a* of two consecutive pairs 19 in direction D, and portion 16*a* of one pair 19 is partially inserted between two portions 16*b* of two consecutive pairs 20 in direction D. Moreover, each pair 19 is offset with respect to each adjacent pair 20 by a spacing P2 equal to half spacing P1.

The two successions B, C of respective pairs 19, 20 are fed through station 8 where double filters 9 and respective projecting bands 10 are fed onto the same plane and inserted between portions 16*c* and 16*a* of pairs 19, and between portions 16*b* and 16*d* of pairs 20 to form groups 21 arranged in successions B and C. In station 8, the position of portions 16*a*, 16*b*, 16*c*, 16*d* remains unchanged, so that groups 21 in successions B and C are also engaged combfashion in the same way as pairs 19 and 20, and the bands 10 projecting with respect to respective filters 9, i.e. the bands 10 laid out flat, do not interfere with groups 21 in the adjacent succession B, C. Moreover, spacing P1 is greater than the length of band 10 laid out flat in direction D, to prevent the band from interfering with the next group 21 in the same succession B, C.

Groups 21, arranged as described, are fed inside station 11 by rolling groups 21 about their respective axes along a common rolling track (not shown) to wind bands 10 about respective double filters 9 and about ends 2*a* of portions 16*c*, 16*a* and ends 2*b* of portions 16*b*, 16*d* to form double filter-tipped cigarettes 22.

Double filter-tipped cigarettes 22, arranged in successions B and C and engaged combfashion in the same way as groups 21, are fed to station 12, where double cigarettes 22 in succession B are shifted axially and perpendicularly to direction D, as shown by arrow F5, to position double cigarettes 22 of succession B between the double cigarettes of succession C and so form a single succession C in which double filter-tipped cigarettes 22 are equally spaced with spacing P2 equal to half spacing P1. In FIG. 1, one double cigarette 22 at station 12 is indicated by a continuous line in succession B and by a dash line in succession C.

Double cigarettes 22 in single succession C are fed through cutting station 13 where cutter 14 cuts double filter 9 of each double cigarette 22 in half to form a pair of single filter-tipped cigarettes 23, each comprising a single cigarette portion 16*a*, 16*b*, 16*c*, 16*d* attached to a single filter 24 formed by cutting respective double filter 9 in half. The cigarettes 23 in each pair are positioned with respective filters 24 facing and adjacent to each other.

At turnover station 15, one cigarette 23 in each pair is turned over through 180°, in the direction of arrow F6, into a position parallel to and side by side with the other cigarette 23 in the same pair, so as form a single succession 25 of equioriented cigarettes 23, i.e. with respective filters 24 all facing the same way.

Figure 2:
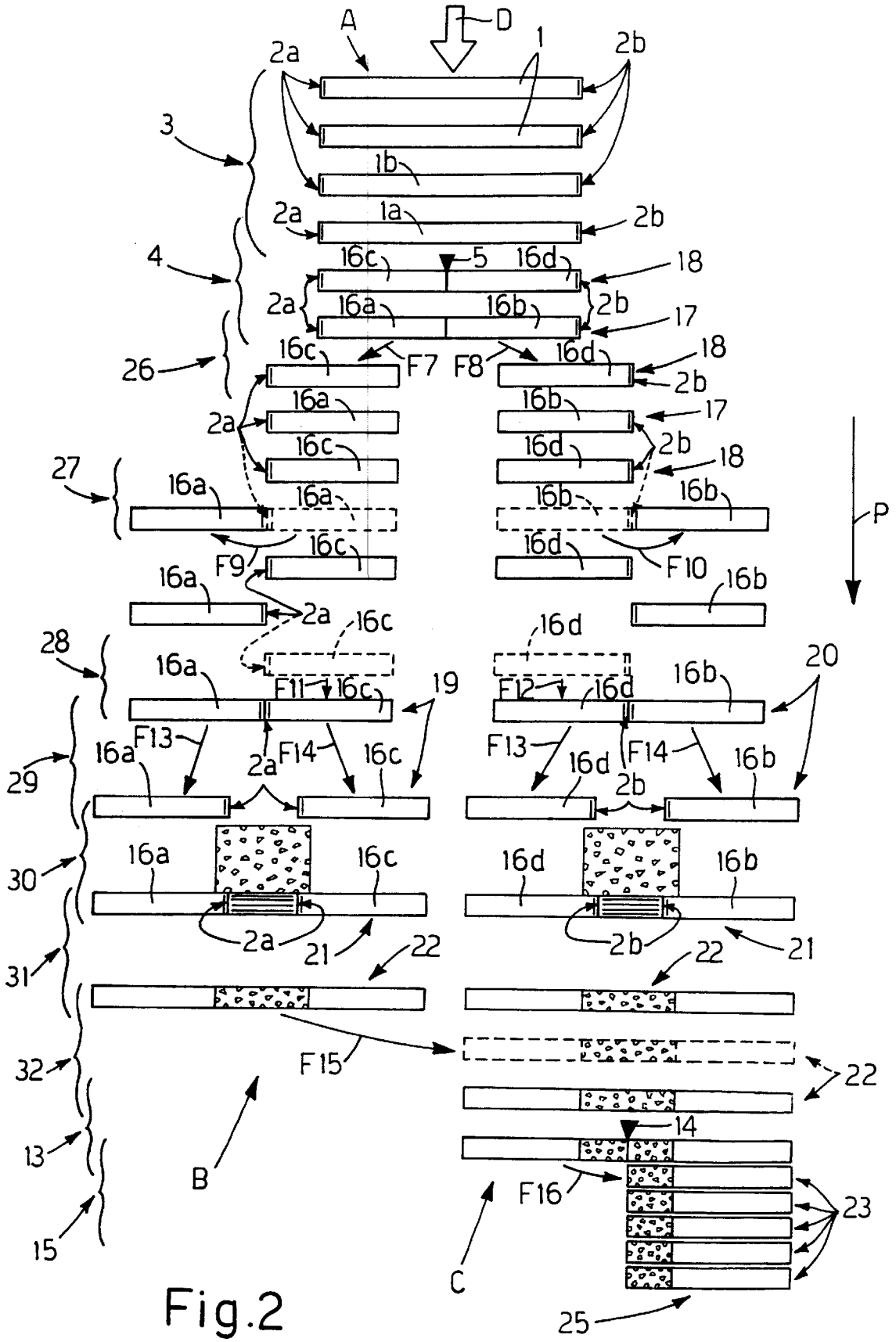
FIG. 2 shows, schematically, a sequence of operations according to a second embodiment of the method according to the present invention.

In the FIG. 2 variation, along path P are arranged successively: supply station 3; cutting station 4 comprising cutter 5; a parting station 26; a turnover station 27; a pairing station 28; a parting station 29; a station 30 for inserting double filters 9 and respective projecting gummed bands 10; a rolling station 31; an axial-transfer station 32; cutting station 13 comprising cutter 14; and turnover station 15.

In actual use, pairs 17 and 18 of single portions 16*a*, 16*b*, 16*c*, 16*d* are fed to station 26 where both single portions 16*a*, 16*b* in pair 17 and single portions 16*c*, 16*d* in pair 18 are parted a given distance along plane G as shown by arrows F7 and F8, and are fed to station 27 where single portions 16*a*, 16*b* in pair 17 are turned over through 180° in opposite directions as indicated by respective arrows F9 and F10, while single portions 16*c*, 16*d* in pair 18 remain in the same position. At station 28, each portion 16*c* is fed in direction D with respect to the adjacent downstream portion 16*a*, and is aligned side by side with portion 16*a*, as shown by arrow F11, to form a pair 19 of single portions 16*a*, 16*c*. Similarly, at station 28, each portion 16*d* is fed in direction D with respect to the adjacent downstream portion 16*b*, and is aligned side by side with portion 16*b*, as shown by arrow F12, to form a pair 20 of single portions 16*b*, 16*d*. Pairs 19 and 20 are then fed, in separate successions B and C, to station 29 where both single portions 16*a*, 16*c* in pair 19 and single portions 16*b*, 16*d* in pair 20 are parted by a given distance of amount (L) along plane G as shown by respective arrows F13 and F14 in FIG. 2.

At station 30, a double filter 9 and respective gummed band 10 are inserted between portions 16*a*, 16*c* of pair 19 and between portions 16*b*, 16*d* of pair 20 to form groups 21, which are fed to rolling station 31 where bands 10 are wound about respective double filters 9 and about the ends of portions 16*a*, 16*c* in pair 19 and the ends of portions 16*b*, 16*d* in pair 20 to form double cigarettes 22, which are fed in separate successions B and C to station 32. At station 32, the double cigarettes 22 in succession B are inserted, as shown by arrow F15 in FIG. 2, between successive double cigarettes 22 in succession C.

Each double cigarette 22 is then cut in half at double filter 9 to form a pair of single cigarettes 23 with the respective filters facing and adjacent to each other; and one cigarette 23 in each pair is turned over, as shown by arrow F16 in FIG. 2, to form a single succession 25 of equioriented cigarettes 23.

Apart from requiring that only some of the rollers (not shown) on the filter-assembly machine (not shown) be doubled in length, both the above embodiments of the method according to the invention are particularly advantageous by ends 2*a* and 2*b* of each portion 1—which are cut on the manufacturing machine (not shown) and therefore not perfectly square with respect to portion 1—being located contacting double filter 9 and covered by band 10.

What is claimed is:

1. A method of conveying bar-shaped tobacco articles on a filter-assembly machine, the method comprising the steps of feeding, in a given traveling direction (D) and in a given plane (G), an orderly succession of bar-shaped first articles (1*a*, 1*b*) arranged crosswise to said traveling direction (D) and in a first succession (A); cutting said first articles (1*a*, 1*b*) in half parallel to said traveling direction to form second articles (16*a*, 16*b*, 16*c*, 16*d*) arranged in said first succession (A); and rearranging said second articles (16*a*, 16*b*, 16*c*, 16*d*) to obtain an orderly second and third succession (B, C) of respective first and second pairs (19, 20) of second articles (16*a*, 16*b*, 16*c*, 16*d*); wherein the second articles (16*a*, 16*b*, 16*c*, 16*d*) in said first succession (A) are rearranged by moving the second articles (16*a*, 16*b*, 16*c*, 16*d*) substantially along said plane (G); partially engaging the first and second pairs (19,20) combfashion by partially inserting one of the second articles (16*b*) of each pair (20) between two other second articles (16*a*) of two consecutive pairs; the first and second pairs (19, 20) being equally spaced with a first spacing (P1) in the respective second and third successions (B, C); and each first pair (19) being offset with respect to each adjacent second pair (20) by a second spacing (P2) equal to half the first spacing (P1).

2. A method as claimed in claim 1, wherein said first and second pairs (19, 20) are engaged combfashion by a length less than the length of each of said second articles (16*a*, 16*b*, 16*c*, 16*d*).

3. A method as claimed in claim 2 comprising the step of inserting a double filter (9) and a respective projecting band (10) between said second articles (16*a*; 16*c*; 16*b*; 16*d*) in each first and in each second pair (19, 20) to form third articles (21) arranged in the second and third successions (B, C); said second articles (16*a*; 16*c*; 16*b*; 16*d*) having first been positioned a given first axial distance from one another.

4. A method as claimed in claim 3, comprising the step of feeding said third articles (21) in said second and third successions (B, C) to a rolling station (11) to wind the bands (10) about said third articles (21) and obtain respective fourth articles (22) arranged in said second and third successions (B, C).

5. A method as claimed in claim 4, comprising the step of moving said fourth articles (22) in the second succession (B) towards said third succession (C) and crosswise to said traveling direction to insert the fourth articles (22) in a single orderly succession defined by said third succession (C) and with said second spacing (P2).

6. A method as claimed in claim 1, wherein said step of cutting said first articles (1*a*, 1*b*) in half produces third and fourth pairs (17, 18) of second articles (16*a*, 16*b*, 16*c*, 16*d*); said third and fourth pairs (17, 18) alternating with one another in the first succession (A); and said step of rearranging the second articles (16*a*, 16*b*, 16*c*, 16*d*) comprising the substeps of positioning the second articles (16*c*, 16*d*) in each fourth pair (18) at a given second axial distance from each other, and maintaining the second articles (16*a*, 16*b*) in each third pair (17) contacting each other end to end.

7. A method as claimed in claim 6, wherein the substep of positioning said second articles (16*c*, 16*d*) in each fourth pair (18) at said second axial distance from each other is performed by turning said second articles (16*c*, 16*d*) in each fourth pair (18) over through 180°.

8. A method as claimed in claim 6, wherein said step of rearranging said second articles comprises the substeps of moving one of the second articles (16*a*) in the third pair (17) into a position coaxial with, and said given first axial distance from, one of the second articles (16*c*) in the fourth pair (18) following said third pair (17) in said traveling direction; and moving the other second article (16*d*) in the fourth pair (18) into a position coaxial with, and said given first axial distance from, the other second article (16*b*) in the first pair (17), to form said first and second pairs (19, 20) of second articles (16*a*, 16*b*, 16*c*, 16*d*).

9. A method of conveying bar-shaped tobacco articles on a filter-assembly machine, the method comprising the steps of feeding, in a given traveling direction (D) and in a given plane, an orderly succession of bar-shaped first articles (1*a*, 1*b*) arranged crosswise to said traveling direction (D) and in a first succession (A); cutting said first articles (1*a*, 1*b*) in half parallel to said traveling direction to form second articles (16*a*, 16*b*, 16*c*, 16*d*) arranged in said first succession (A); and rearranging said second articles (16*a*, 16*b*, 16*c*, 16*d*) to obtain an orderly second and third succession (B,C) of respective first and second pairs (19, 20) of second articles (16*a*, 16*b*, 16*c*, 16*d*); wherein the second articles (16*a*, 16*b*, 16*c*, 16*d*) in said first succession (A) are rearranged by moving the second articles (16*a*, 16*b*, 16*c*, 16*d*) substantially along said plane; cutting said first articles (1*a*, 1*b*) forming third pairs (17) and fourth pairs (18) each having two respective second articles (16*a*, 16*b*, 16*c*, 16*d*); wherein the step of rearranging said second articles (16*a*, 16*b*, 16*c*, 16*d*) comprises the substep of turning said two second articles (16*a*, 16*b*) of each third pair (17) over through 180° in opposite directions (F9, F10).

* * * * *